US009033617B2

(12) United States Patent
Perol et al.

(10) Patent No.: US 9,033,617 B2
(45) Date of Patent: May 19, 2015

(54) STRUCTURE FOR TRANSPORTING, INSTALLING AND DISMANTLING A RIG DECK AND METHODS FOR TRANSPORTING, INSTALLING AND DISMANTLING THIS DECK

(75) Inventors: Christian Perol, Viroflay (FR); Marc Cahay, Villemomble (FR)

(73) Assignee: TECHNIP FRANCE (FR)

( * ) Notice: Subject to any disclaimer, the term of this patent is extended or adjusted under 35 U.S.C. 154(b) by 258 days.

(21) Appl. No.: 13/322,596

(22) PCT Filed: May 25, 2010

(86) PCT No.: PCT/FR2010/051000

§ 371 (c)(1),
(2), (4) Date: Jan. 27, 2012

(87) PCT Pub. No.: WO2010/136713

PCT Pub. Date: Dec. 2, 2010

(65) Prior Publication Data

US 2012/0110819 A1 May 10, 2012

(30) Foreign Application Priority Data

May 26, 2009 (FR) ..... 09 53455

(51) Int. Cl.
*B63B 9/06* (2006.01)
*E02B 17/08* (2006.01)
*E02B 17/00* (2006.01)

(52) U.S. Cl.
CPC ..... *B63B 9/065* (2013.01); *E02B 17/0818* (2013.01); *E02B 2017/0047* (2013.01); *E02B 2017/0052* (2013.01)

(58) Field of Classification Search
CPC ..... E02B 17/00; E02B 17/04; E02B 17/08; E02B 17/0818; E02B 17/021; E02B 2017/0039; E02B 2017/0043; E02B 2017/0047; E02B 2017/0052; B63B 9/065; B63B 35/003; Y02E 10/727
USPC ..... 405/195.1, 196, 198, 203, 204, 209; 114/61.1, 264, 265
See application file for complete search history.

(56) References Cited

U.S. PATENT DOCUMENTS 4,648,751 A * 3/1987 Coleman ..... 405/209
4,973,200 A * 11/1990 Kaldenbach ..... 405/205

(Continued)

FOREIGN PATENT DOCUMENTS

GB 2174648 A 11/1986
WO WO 01/90487 A1 11/2001

OTHER PUBLICATIONS

International Search Report dated Nov. 12, 2010, issued in corresponding international application No. PCT/FR2010/051000.

(Continued)

*Primary Examiner* — Sean Andrish
(74) *Attorney, Agent, or Firm* — Ostrolenk Faber LLP

(57) ABSTRACT

The invention relates to a structure for transporting, installing, and dismantling a deck (1) of an off-shore exploitation rig, for installing, and dismantling this deck (1) on at least one supporting column, characterized in that it comprises two transport barges (20) and means (30) for supporting and raising the deck (1), temporarily connected to said deck and to said barges and configured to be supported by these barges for supporting said deck between said barges and a method for transporting, installing, and dismantling the deck (1) using the structure for transporting, installing, and dismantling the deck (1).

10 Claims, 12 Drawing Sheets

(56) References Cited

U.S. PATENT DOCUMENTS

| | | | | |
|---|---|---|---|---|
| 5,662,434 | A | 9/1997 | Khachaturian | |
| 5,975,807 | A | 11/1999 | Khachaturian | |
| 6,171,028 | B1 | 1/2001 | Van Gelder | |
| 6,318,931 | B1 | 11/2001 | Khachaturian | |
| 6,347,909 | B1 * | 2/2002 | Kocaman | 405/209 |
| 6,374,764 | B1 | 4/2002 | Davenport, III et al. | |
| 2008/0131209 | A1 * | 6/2008 | Thomas | 405/198 |

OTHER PUBLICATIONS

French Search Report dated Feb. 23, 2010, issued in corresponding French priority application No. 0953455.

* cited by examiner

STRUCTURE FOR TRANSPORTING, INSTALLING AND DISMANTLING A RIG DECK AND METHODS FOR TRANSPORTING, INSTALLING AND DISMANTLING THIS DECK

CROSS-REFERENCE TO RELATED APPLICATIONS

The present application is a 35 U.S.C. §§371 national phase conversion of PCT/FR2010/051000, filed May 25, 2010, which claims priority of French Application No. 0953455, filed May 26, 2009, the contents of which are incorporated by reference herein. The PCT International Application was published in the French language.

BACKGROUND OF THE INVENTION

The present invention relates to a structure for transporting, installing and dismantling a deck of an off-shore exploitation rig.

The invention also relates to methods for transporting, installing and dismantling a deck of a sea platform by means of such a structure.

For oil development, it is known how to place above an oil deposit, a fixed or floating platform which comprises a deck notably bearing exploitation equipment and living quarters.

The deck is mounted on a supporting structure consisting of at least one supporting column supported on the sea bed or anchored on the latter.

In order to install the deck on this supporting structure, it is known how to use lifting cranes mounted on barges and which allow transfer of the deck from the transport ship onto this structure.

This method which is the most widespread up to now has limitations.

Indeed, the first of these limitations is the capacity of the lifting cranes which may impose that the deck be made in several elements which significantly increases the manufacturing cost of this deck and the cost for installing and dismantling the deck of the platform.

The second limitation lies in the fact that this method imposes the availability of a relatively long favorable time window in order to be able to perform the different transfer operations at sea under good conditions.

Thus, this method may be difficult to apply without considerably increasing the cost in areas where the time windows are relatively short, such as for example in the North Sea.

A second method consists of installing the deck of the platform in a single block on the supporting structure by having it float above the latter.

Next, the deck is positioned on this structure by a ballasting-deballasting system.

In the case of such a ballasting-deballasting system, the deck of the platform is supported by a floating support notably formed by two barges.

One of the important operations lies in the installation of the deck of the platform on these two transport barges.

Indeed, the deck of the platform has to be manufactured and assembled on a same manufacturing site and then transferred from the manufacturing site onto a transfer barge by known means. This transfer barge supporting the deck is then towed towards another site in order to transfer the deck onto two transport barges there.

The transfer barge supporting the deck is brought closer to one of the transport barges which includes means for fixedly supporting the deck. The deck of a platform includes on its sides, complementary means for engaging with the fixed supporting means of the first transport barge.

These complementary engagement means are engaged on the fixed supporting means by moving the transfer barge towards the first transport barge.

Next, the second transport barge which also includes similar fixed supporting means is moved towards the opposite side of the deck of the platform so as to engage the complementary engagement means on the fixed supporting means of the second transport barge.

When both transport barges are engaged under the deck, the transfer barge is then ballasted in order to transfer the whole load of the deck onto the two transport barges.

The transfer barge is then withdrawn and both transport barges supporting the deck are towed up to the exploitation site. The deck is then transferred onto the supporting structure which, in the case of a floating structure is then deballasted in order to transfer the deck onto this supporting structure. Both transport barges may then be reused for another transport.

The installation of the deck on the supporting structure is carried out in the open sea and sea conditions are not always perfect and a residual swell is permanently present.

Consequently, one of the problems posed by this installation method lies in the fact that the elements of the barges supporting the deck will hit this deck under the effect of the swell driving these elements into a to-and-fro motion.

Moreover, in U.S. Pat. No. 6,374,764, a third method is known for installing a deck on a supporting structure which consists of fitting out this deck, on two opposite sides, with legs supporting a barge. Each leg secured to the deck is associated with a driving mechanism with which said deck may be lifted when the barges are floating in order to displace it above the supporting structure.

But, the main drawback of this method lies in the fact that the deck equipped with legs and barges is made more heavy which increases the mass which the supporting structure has to support.

The object of the invention is to propose a structure for transporting a deck of an off-shore platform which avoids these drawbacks and which is designed in order to simplify and reduce the time for installing and dismantling this deck.

For this purpose, the object of the invention is a structure for transporting, installing and dismantling a deck of an off-shore platform, for installing or dismantling this deck on at least one supporting column, characterized in that it comprises two transport barges and means for supporting and lifting the deck, independent of said deck on the one hand and independent of said barges on the other hand and capable of being borne by these barges in order to support said deck between said barges.

The transport structure according to the invention may include one or more of the following features:

- the supporting and lifting means are formed with substantially vertical columns each including means for temporary attachment onto the corresponding barge, said attachment means allowing angular displacement of the corresponding column on either side of the longitudinal axis of the barge,
- the attachment means form a temporary supporting area of each column on the barge;
- each column is provided with a shuttle which may be displaced by mechanical driving means on the corresponding column and including means for temporary connection with the deck,
- the temporary attachment means of each column are formed with a half axle provided at the base of the column and extending parallel to the longitudinal axis of the corresponding barge and with a housing having a shape mating said half-axle and made on said barge, each column is associated with assemblies of legs for maintaining it in a substantially vertical position, said legs being secured to the barge and providing with the corresponding column play for angular displacement of said column, the mechanical driving means of each shuttle comprise at least two opposite assemblies, borne by the corresponding shuttle and each formed by a pinion driven into rotation and capable of cooperating with a rack borne by the corresponding column, and means for temporary connection of the shuttles with the deck comprise complementary fitting members borne by said shuttles and said deck and members for locking the deck on the shuttles.

The object of the invention is also a method for transporting and installing a deck of an off-shore platform onto at least one supporting column by means of a structure as defined above, characterized in that it includes the following steps:

a) the deck is transferred from an assembly quay onto a transfer barge, b) the transfer barge bearing the deck is displaced and this transfer barge is placed between two barges of the transport structure, c) the shuttles are displaced upwards on the columns in order to secure these shuttles with the deck by the temporary connection means, d) the deck is lifted by the shuttles in order to move it away from the transfer barge, e) the columns are wedged on the assemblies of supporting legs and the transfer barge is withdrawn, f) the shuttles bearing the deck are lowered and the deck is attached onto the barges, g) the barges are displaced in order to bring the deck up to the exploitation site including at least said column, h) the deck is detached from the barges, i) the deck is lifted by the shuttles, j) the barges are displaced in order to place the deck above at least said supporting column, k) the shuttles are lowered, l) the deck is laid on at least said supporting column, m) the deck is detached from the shuttles, n) the shuttles are lowered, and o) the transport barges are withdrawn.

An object of the invention is also a method for dismantling and transporting a deck of an off-shore platform by means of a structure as defined above, characterized in that it includes the following steps:

a) the barges fitted out with columns beforehand each bearing one shuttle is placed on either side of said at least supporting column, b) the shuttles are displaced upwards on the columns in order to secure the shuttles with the deck through the temporary connection means, c) the deck is detached from said at least supporting column, d) the deck is lifted by the shuttles in order to move it away from said at least supporting column e) the barges bearing the deck are displaced, f) the shuttles bearing the deck are lowered and the deck is attached onto the barges, g) the barges are displaced in order to bring the deck up to a transfer barge, h) the deck is detached from the barges, i) the deck is lifted by the shuttles, j) the transfer barge is placed between the barges and above the deck, k) the shuttles are lowered in order to lay the deck on the transfer barge, l) the deck is attached onto the transfer barge, m) the deck is detached from the shuttles, n) the shuttles are lowered, o) the barges are withdrawn, and p) the deck is transported by the transfer barge up to a dismantling site.

The invention will be better understood upon reading the description which follows, only given as an example and made with reference to the appended drawings, wherein:

With the purpose of facilitating the understanding of the drawings, the scales between the different elements making up the structure are not always observed.

DESCRIPTION OF A PREFERRED EMBODIMENT

In the figures, a deck 1 of a platform intended to be transferred between an assembly quay, not shown and an exploitation site, as this will be seen subsequently, is schematically illustrated.

This deck 1 in the exemplary embodiment illustrated in the figures is formed with a trellis structure. According to an alternative, this deck 1 may be formed with a solid structure.

Figure 1:
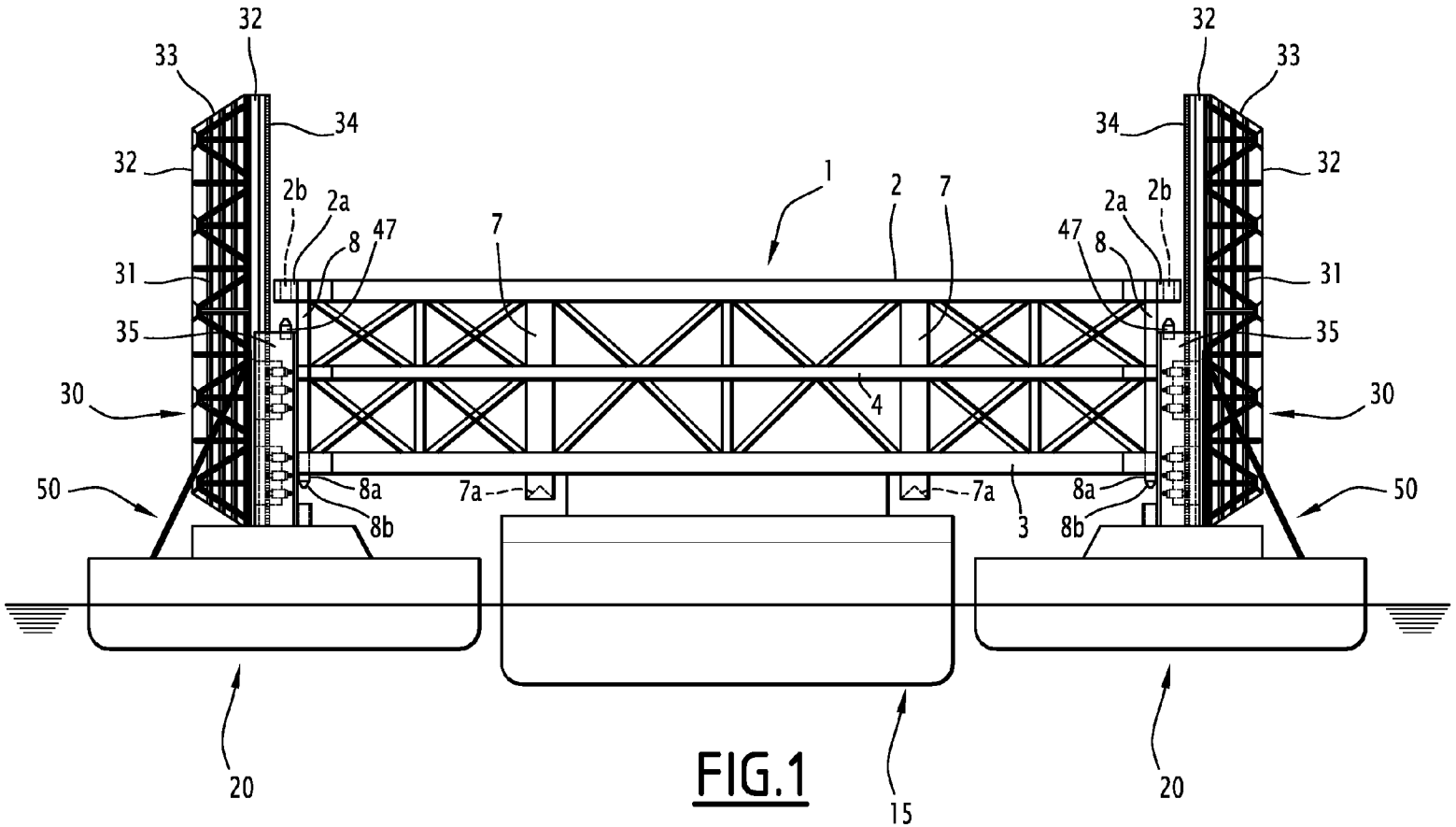
FIG. 1 is a schematic front view of a transport structure according to the invention, and of a barge for transferring a deck of a platform.
Figure 2:
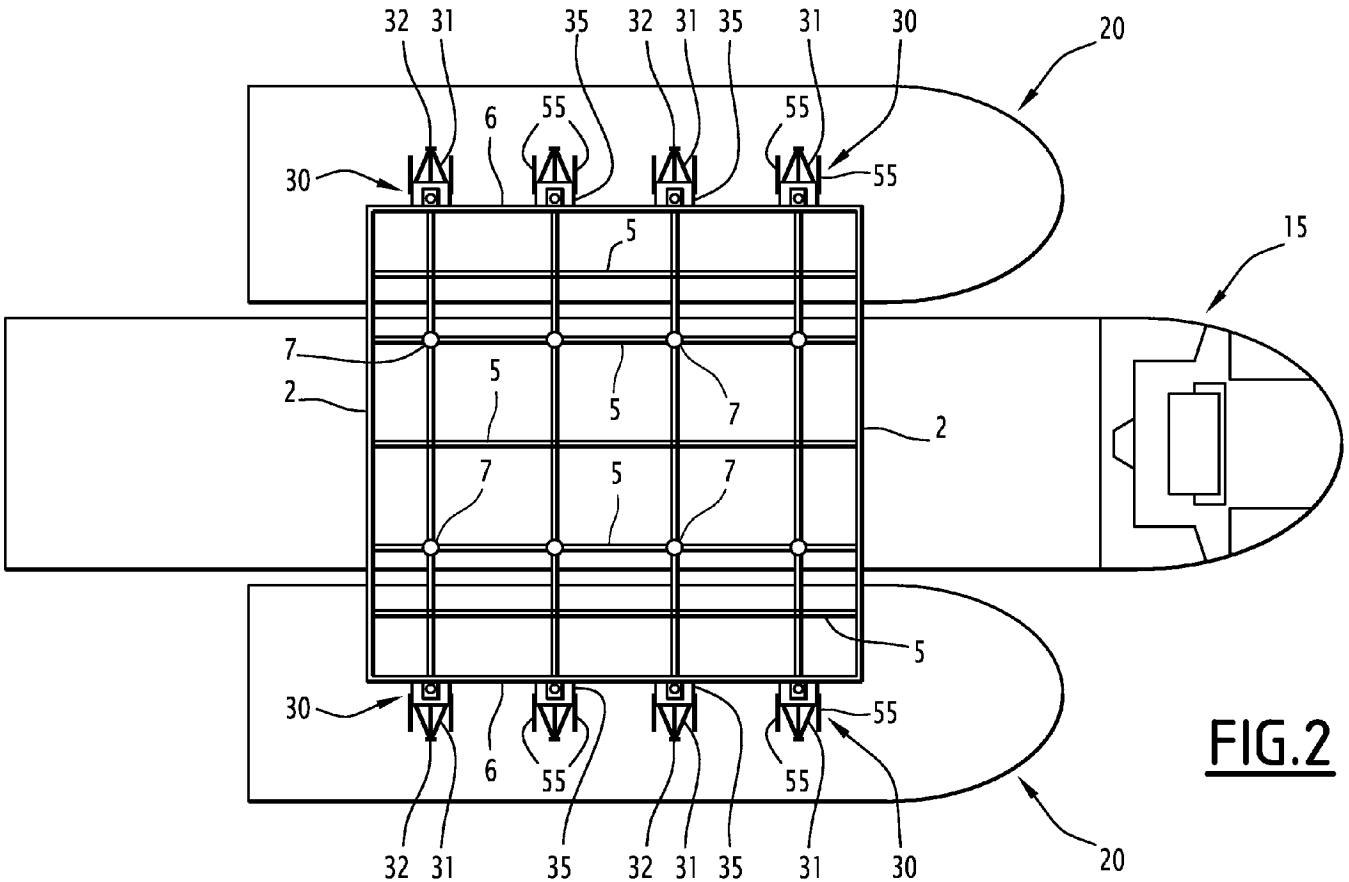
FIG. 2 is a schematic top view of FIG. 1.

As illustrated in FIGS. 1 and 2, the trellis structure of the deck 1 consists of transverse and horizontal parallel beams 2 and 3, upper 2 and lower 3 beams respectively.

The trellis structure of the deck 1 also includes intermediate transverse beams 4 (FIG. 1), extending parallel to the beams 2 and 3.

The upper 2, lower 3 and intermediate 4 transverse beams are connected together through intermediate longitudinal beams 5 and through lateral longitudinal beams 6 (FIG. 2).

The upper transverse beams 2 and the intermediate longitudinal beams 5 and the lateral beams 6 associated therewith form the upper portion of the deck 1 and the lower transverse beams 3 and the intermediate longitudinal beams 5 and the lateral beams 6 associated therewith form the lower portion of the deck 1.

The intermediate beams 4 are connected together also through intermediate longitudinal beams 5, The beams 2, 5 and 6 of the upper portion of the deck 1 and the intermediate beams 4 and 5 as well as the beams 3, 5 and 6 of the lower portion of this deck 1 are connected together through intermediate vertical beams 7 and through lateral vertical beams 8, as shown in FIGS. 1 and 2.

Figure 10:
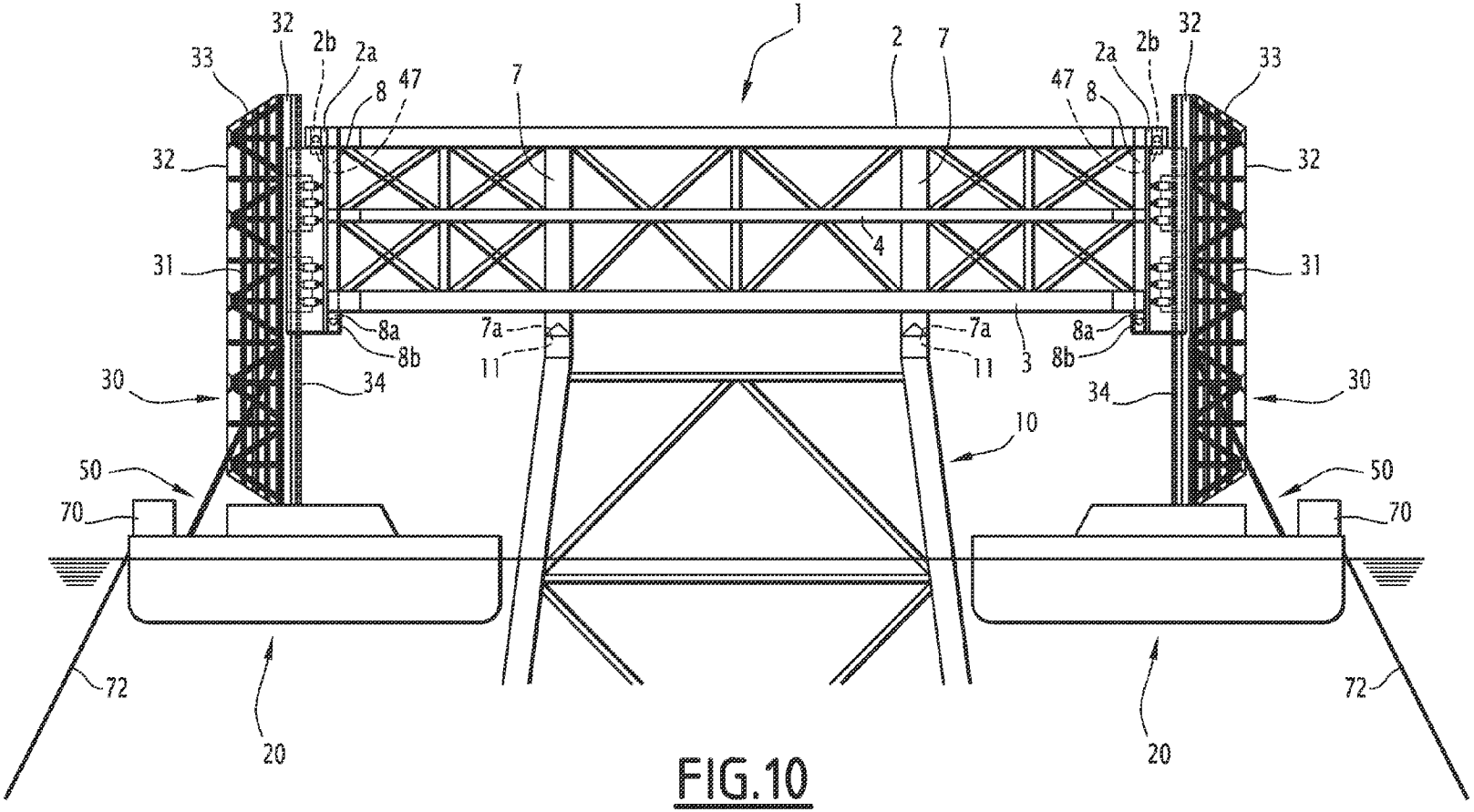

As illustrated in FIG. 1, the intermediate vertical beams 7 each include at its lower portion, a frusto-conical housing 7*a* intended to cooperate with a conical end piece 11 with a mating shape, made in the upper portion of at least one supporting column 10 of an off-shore exploitation rig (FIG. 10).

As illustrated in FIG. 1, the two end transverse beams 2, 3, include at each end a protruding portion 2*a* provided with preferably a cylindrical housing. This housing 2*b* may have a conical or frusto-conical shape.

The lateral vertical beams 8 include below the lower transverse beam 3 a protruding portion 8*a* forming a lug 8*b*.

The different beams making up the deck 1 are assembled on an assembly quay not shown and this deck 1 is transferred onto a transfer barge 15 with suitable means of a known type, not shown. The transfer barge 15 bearing the deck 1, as illustrated in FIGS. 1 and 2, is displaced and brought between two transport barges 20, forming a transport structure according to the invention.

Referring now to FIGS. 1 to 5, a transport barge 20 will be described, the other transport barge 20 being identical.

Generally, the transport barge 20 includes means 30 for supporting and lifting this deck, independent of said deck 1 on the one hand and independent of said barges 20 on the other hand, these supporting and lifting means 30 being able to be borne by these barges 20 in order to support said deck between said barges 20.

The supporting and lifting means 30 are formed with substantially vertical columns 31 which, in the exemplary embodiment illustrated in the figures, are four in number for each barge 20. Each column 31 includes means 50 (FIGS. 3 and 4) for temporary attachment onto the barge 20. These means 50 allow angular displacement of the corresponding column 31 on either side of the longitudinal axis of the barge 20.

As an example, each column 31 has a triangular cross-section, but these columns 31 may have a square or circular cross-section.

Each column 31 is formed with three substantially parallel and vertical chords 32 connected together through a trellis of metal girders 33.

Figure 5:
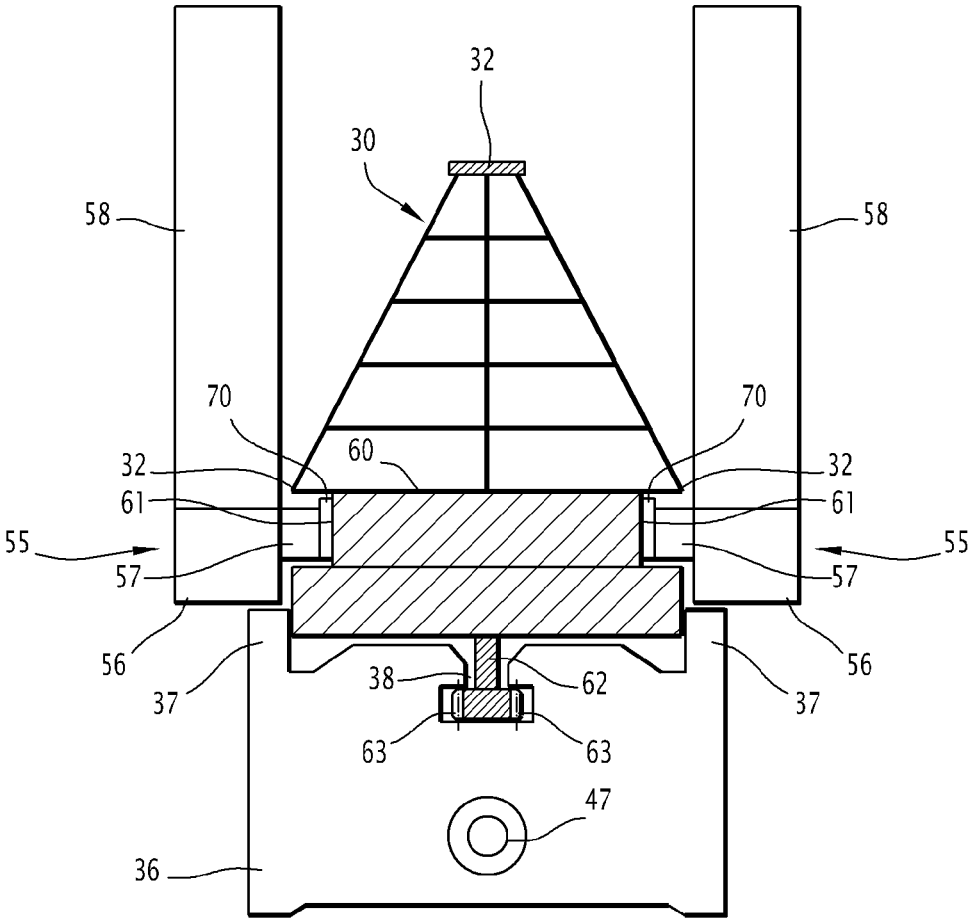
FIG. 5 is a sectional view along the line 5-5 of FIG. 3, FIGS. 6 to 12 are schematic views showing the different steps of the method for transporting and installing a deck on a supporting column of a platform.

As illustrated in FIG. 5, each of the columns 31 includes on its face positioned parallel to the longitudinal axis of the barge 20, a vertical plate 60 substantially extending over the whole height of the column 31. The vertical plate 60 is provided on each of its lateral edges, with a vertical groove 61.

The vertical plate 60 bears a double rack 63 by means of a chord 62.

Figure 3:
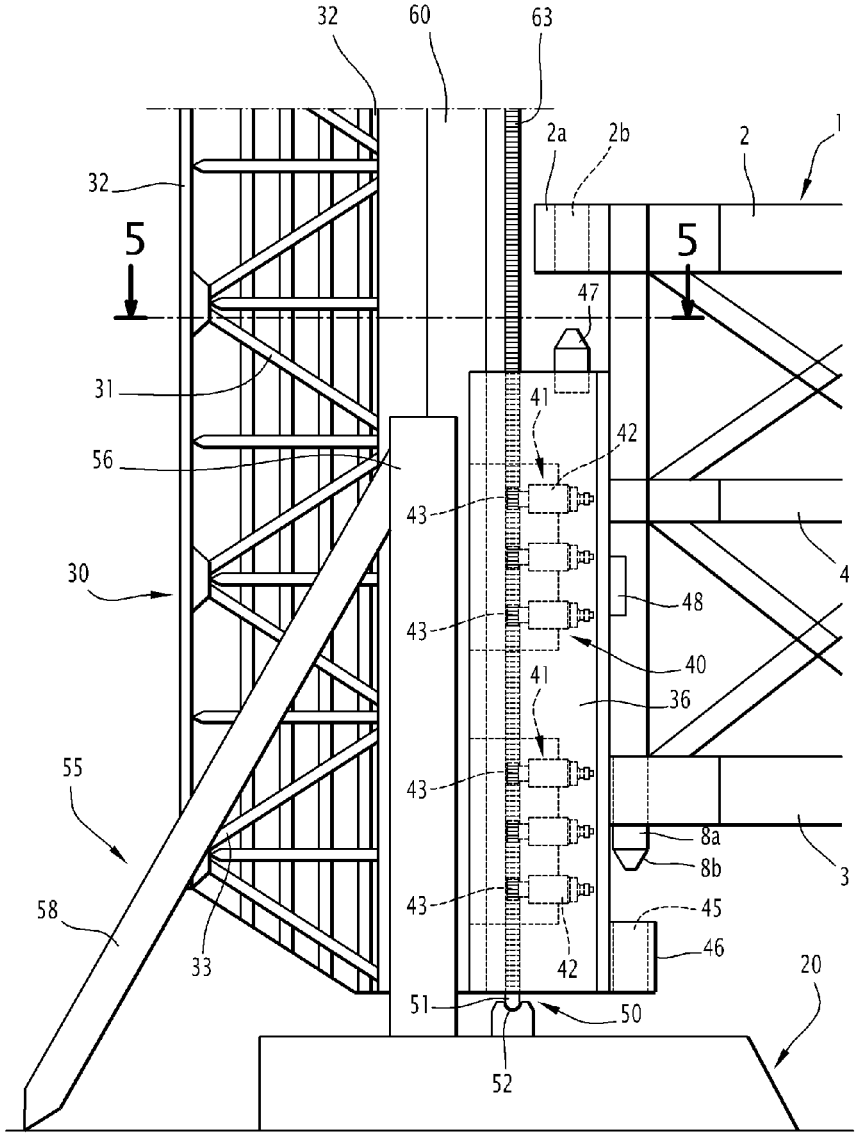
FIG. 3 is a schematic side view of a shuttle on a column of the structure according to the invention.
Figure 4:
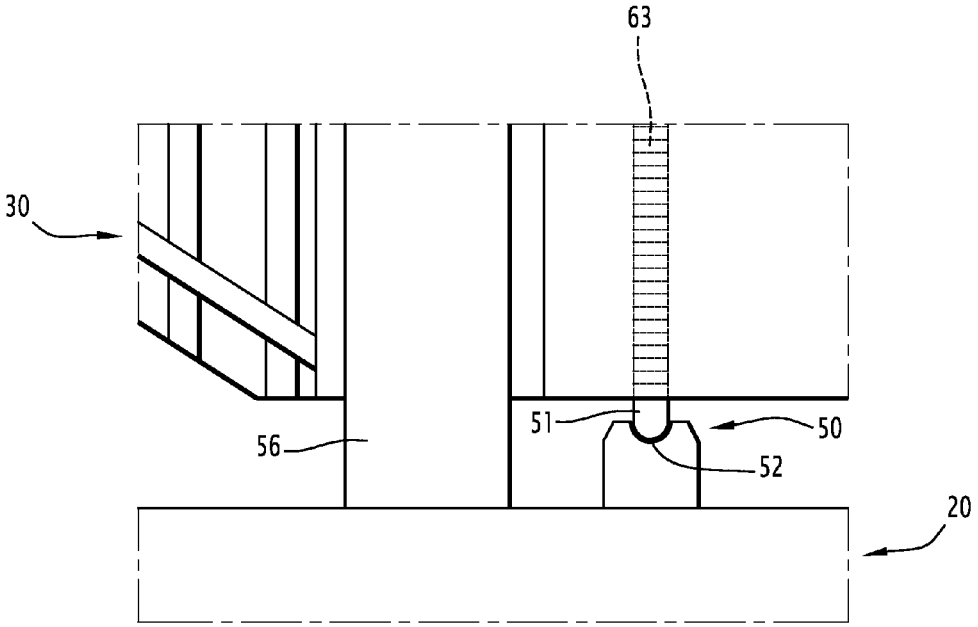
FIG. 4 is a schematic side view and on a larger scale of the lower portion of a column.

As shown in FIGS. 3 and 4, the means 50 for temporary attachment of the column 31 onto the barge 20 are formed with a half-axle 51 made at the base of this column 31 and more particularly at the base of the double rack 63. These means 50 also include a housing 52 with a shape mating that of the half-axle 51 and made on the barge 20.

More specifically, the means 50 form a temporary supporting area for each column 31 on the barge 20 by ensuring the positioning of the corresponding column, relatively to the barge.

Thus, the conjugate shape of the half-axle 51 and of the mating housing 52 allows angular displacement of the corresponding column 31 on either side of the longitudinal axis of the barge 20.

In order to limit this angular displacement, the column 31 is associated with at least one assembly of legs 55 for maintaining said column 31 in a substantially vertical position.

Each assembly of legs 55 is placed on one side of the column 31. Each assembly of legs 55 comprises a substantially vertical beam 56 attached onto the barge 20 and including a protruding edge 57 intended to cooperate with a groove 61 of the vertical plate 60. Each assembly of legs 55 also includes an oblique holding beam 58 connecting the corresponding beam 56 to the barge 20, as shown in FIG. 3.

Each protruding edge 57 provides with the corresponding groove 61 play allowing angular displacement of the column 31.

With each column 31 is associated a shuttle 35 which may be displaced by mechanical driving means 40 along the corresponding column 31.

Each shuttle 35 is formed by a body 36 (FIG. 3) provided on each side with a lateral edge 37 cooperating with the plate 60 of the column 31 in order to ensure guidance of the body 36 of the shuttle 35 during its displacement along said vertical plate 60.

The body 36 of the shuttle 35 includes a vertical central passage 38 with a shape mating the chord 62 and the double rack 63, as is apparent in FIG. 5.

The mechanical means 40 for driving each shuttle 35 on the corresponding column 31 comprise several assemblies 41 distributed on either side of the passage 38, according to the height of the latter.

Each assembly 41 comprises a reduction gear motor 42 ensuring the driving of a pinion 43 which meshes with a rack 34 of the double rack 63.

In the embodiment illustrated in the figures, each rack is associated with two groups of three pinions 43 each driven into rotation by a reduction gear motor 42.

The mechanical means 40 may be formed with any other system, such as for example a stepping drive system or a system with actuators.

Each shuttle 35 includes means for temporary connection with the deck 1.

As shown at a larger scale in FIG. 3, the temporary connection means are formed with complementary fitting members borne by the shuttle 35 and the deck 1. These complementary fitting members are formed with a housing 45 made in an edge 46 provided at the base of the plate 36 of the corresponding shuttle 35. This housing 45 is intended to cooperate with a lug 8*b* of the deck 1.

The temporary connection means also comprise a lug 47 provided at the upper portion of the plate 36 of the corresponding shuttle 35 which is intended to cooperate with the housing 2*b* of the deck 1. Finally, the temporary connection means between each shuttle 35 and the deck 1 also comprise locking members 48, for locking the deck 1 on each of the shuttles 35.

According to an alternative, the lugs 47 and 8*b* may both be borne by the shuttle 35 and the housings 45 and 2*b* borne by the deck 1.

In the exemplary embodiment illustrated in the figures, the columns 31 are mounted on each of the barges 20.

Transshipment of the deck 1 from the transfer barge 15 onto the transport barges 20 is achieved in the following way.

The transfer barge 15 including the deck 1 is placed between both transport barges 20 and these transport barges 20 are gradually displaced towards each other in the direction of the deck 1.

The transport barges 20 are displaced towards the deck 1 until the shuttles 35 of said barges 20 come into contact with the lateral vertical beams 8, as shown in FIGS. 1 to 3.

Next, the shuttles 35 are moved upwards on the columns 31 by means of the reduction gear motors 42 which drive into rotation the pinions 43 meshing with the double racks 34 in order to bring the edge 46 into contact with the lower portion of the deck 1 and the upper edge of the plate 36 of each shuttle 35 into contact with the protruding portion 2*a* of the upper portion of the deck 1.

The lugs 8*b* penetrate into the housings 45 and the lugs 47 penetrate into the housings 2*b* (FIG. 3).

The first phase which consists of aligning the lugs 8*b* and 47 with the housings 45 and 2*b* by moving the shuttles 35 upwards does not generate any force in the columns 31.

When the shuttles 35 continue to move upwards in order to transfer the totality of the load of the deck 1 onto the barges 20, significant forces may be generated in the mechanical means 40 if the columns 31 are rigidly mounted on the barges 20.

The columns 31 may freely and slightly tilt by means of the mounting of these columns 31 on the barge 20 by means of the half-axle 51 of the housing 52 and thanks to the play existing between the protruding edges 57 and the grooves 61. Thus the lugs 8*b* and 47 may freely align with the housings 45 and 2*b* without generating any force.

The deck 1 is secured to the shuttles 35 with locking members 48.

Figure 6:
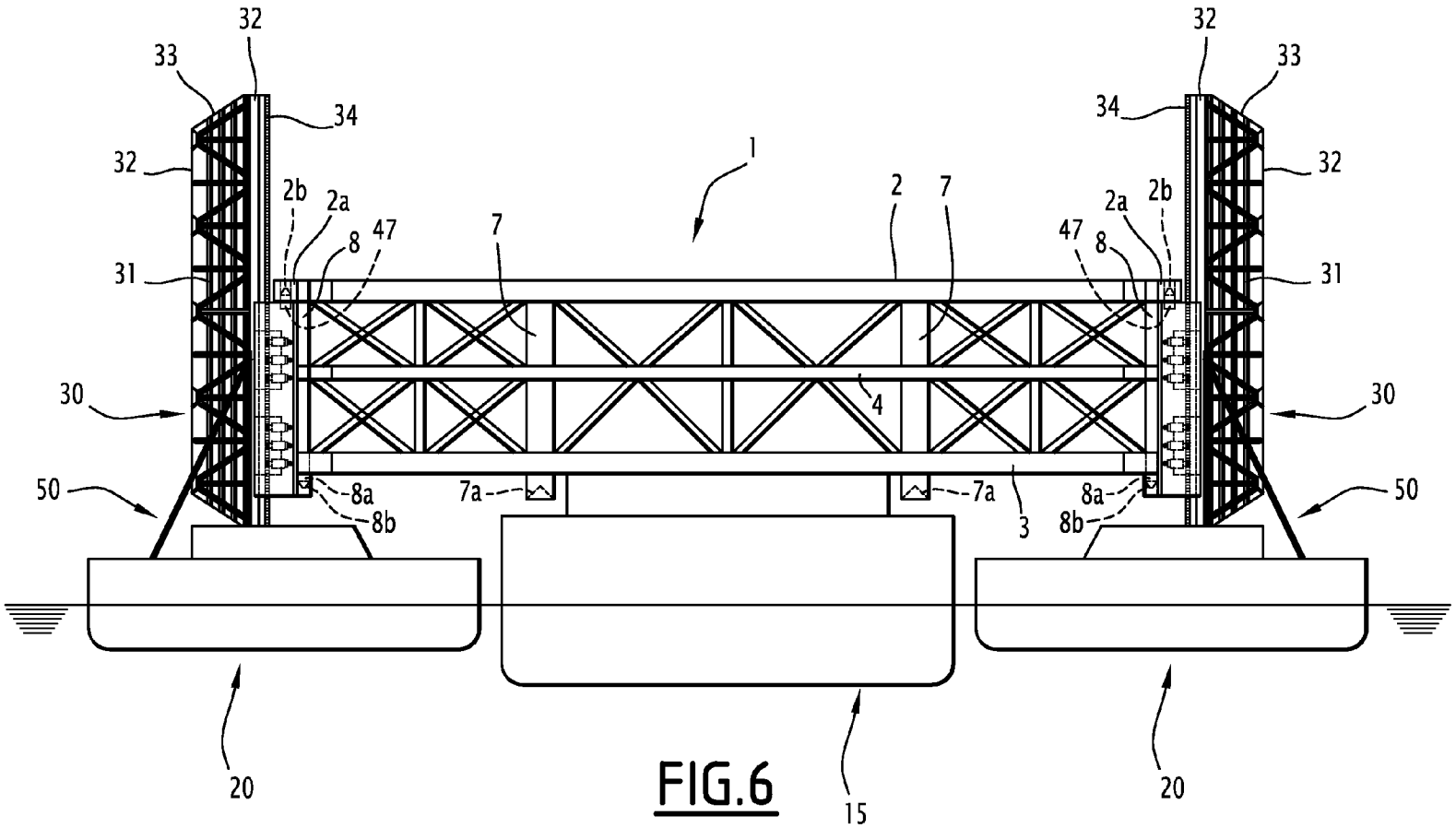
Figure 7:
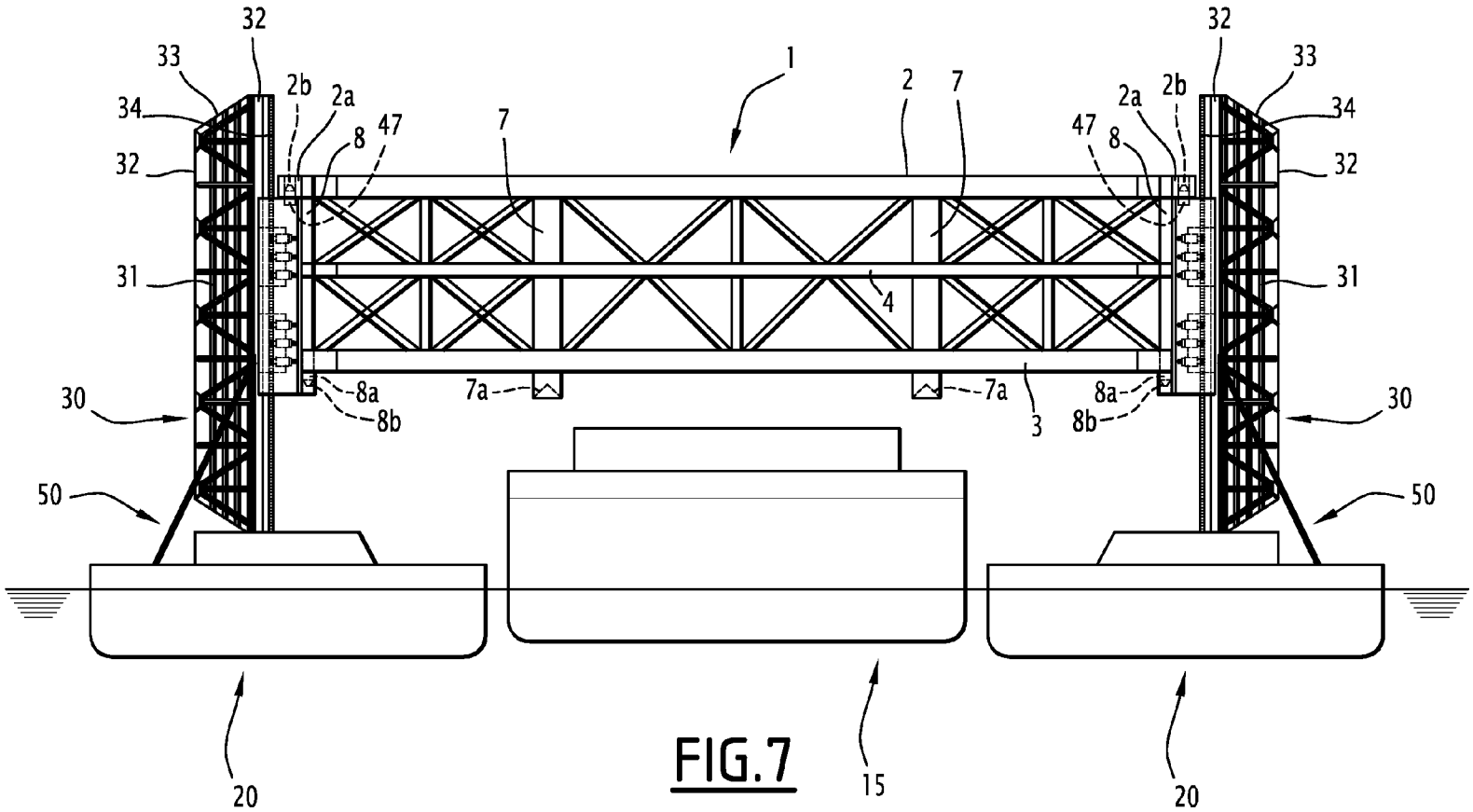

Next, the deck 1 is lifted by the shuttles 35 in order to move it away from the transfer barge 15 (FIGS. 6 and 7) and this transfer barge 15 is withdrawn.

Figure 8:
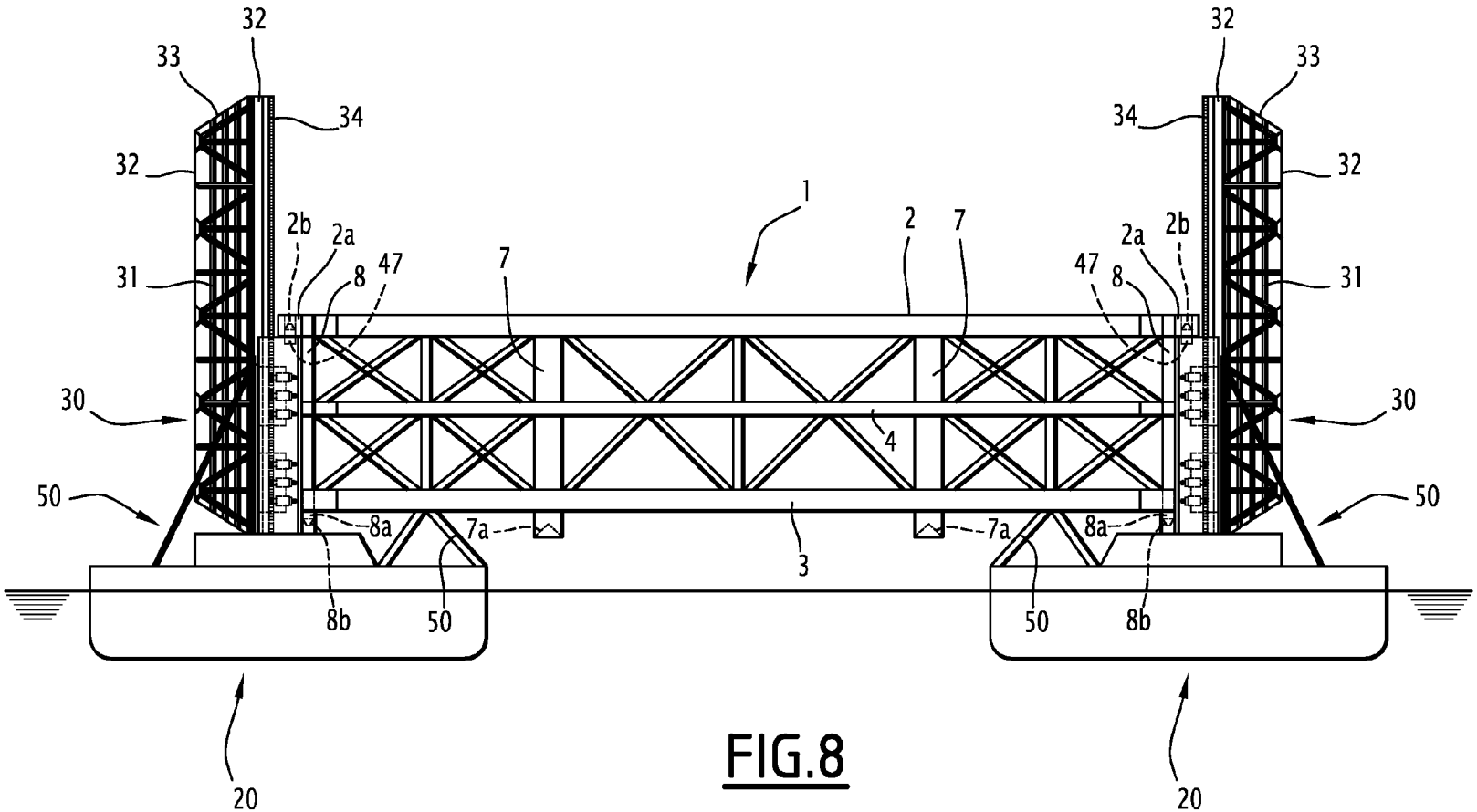

After withdrawing the transfer barge 15, the shuttles 35 bearing the deck 1 are brought back to a low position bearing against the deck of each barge 20 (FIG. 8) and the deck 1 is attached onto the barges 20 by means of tie-rods or slings 50 or by means of any other suitable element.

Next, the columns 31 are wedged by introducing wedges 70 (FIG. 5), between the protruding edges 57 and the grooves 61 so as to obtain a rigid assembly during the transport.

The barges 20 are displaced in order to bring the deck 1 up to the exploitation site on which at least one supporting column 10 of the platform has been installed beforehand.

Figure 9:
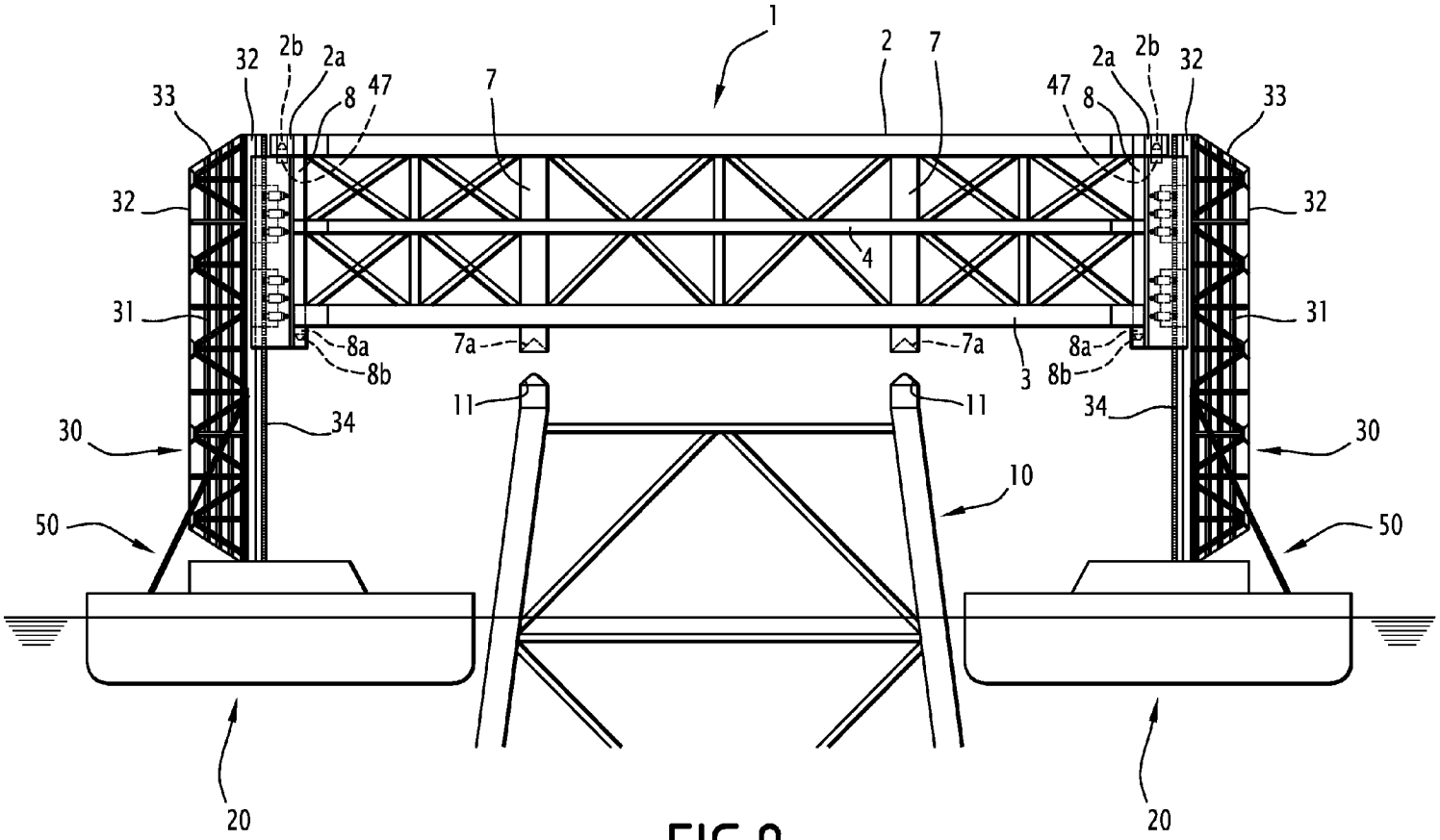

The deck 1 is detached from the barges 20 by withdrawing the attachment elements 50 and this deck 1 is lifted by the shuttles 35 (FIG. 9) and the transport barges 20 are displaced in order to position the deck 1 above said at least one supporting column 10 (FIG. 9).

The deck 1 is lowered by the shuttles 35 so as to lay this deck on said at least supporting column 10 by having the conical endpieces 11 penetrate into the frusto-conical housings 7*a* of the deck 1 (FIG. 10).

Figure 11:
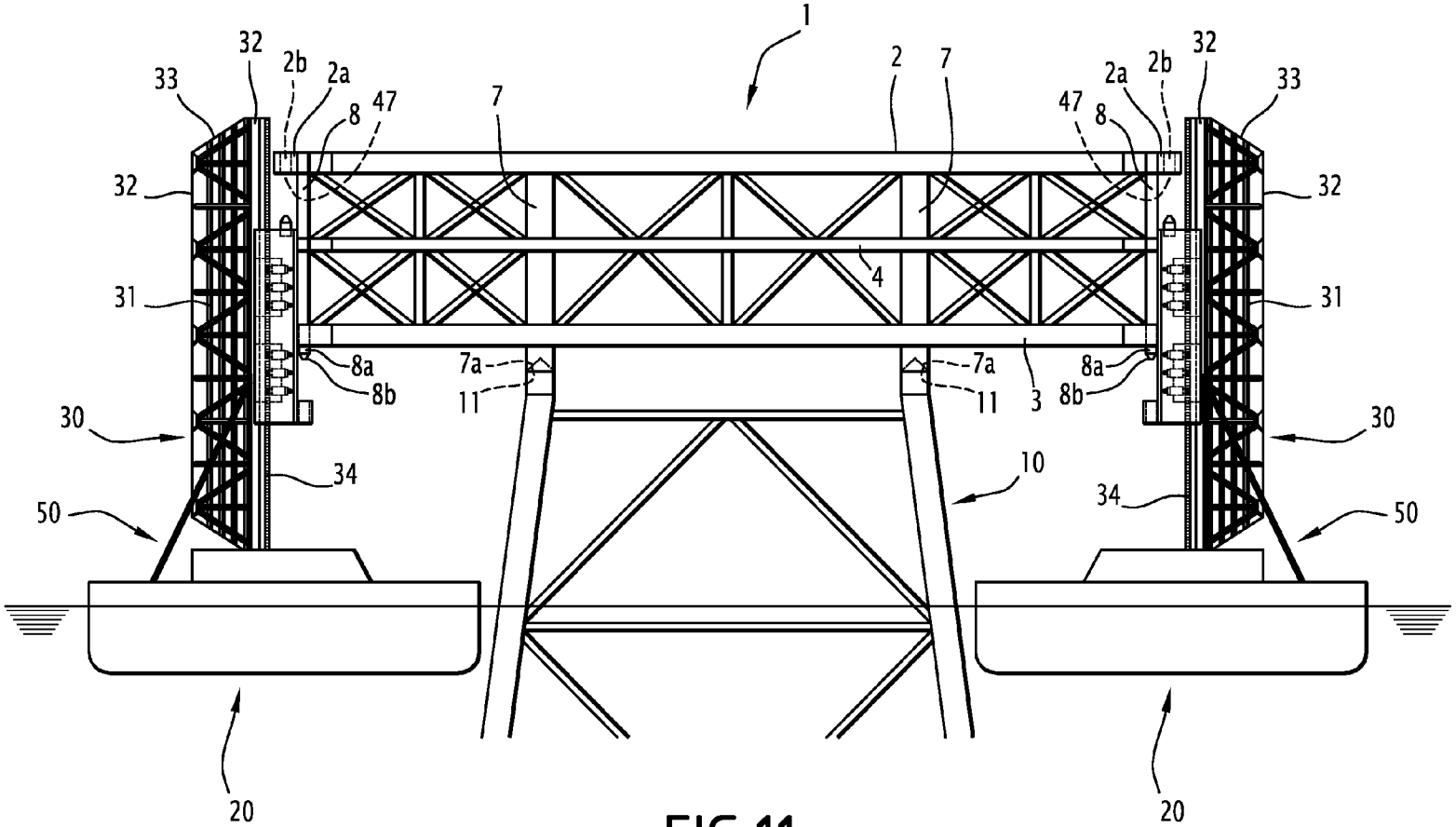
Figure 12:
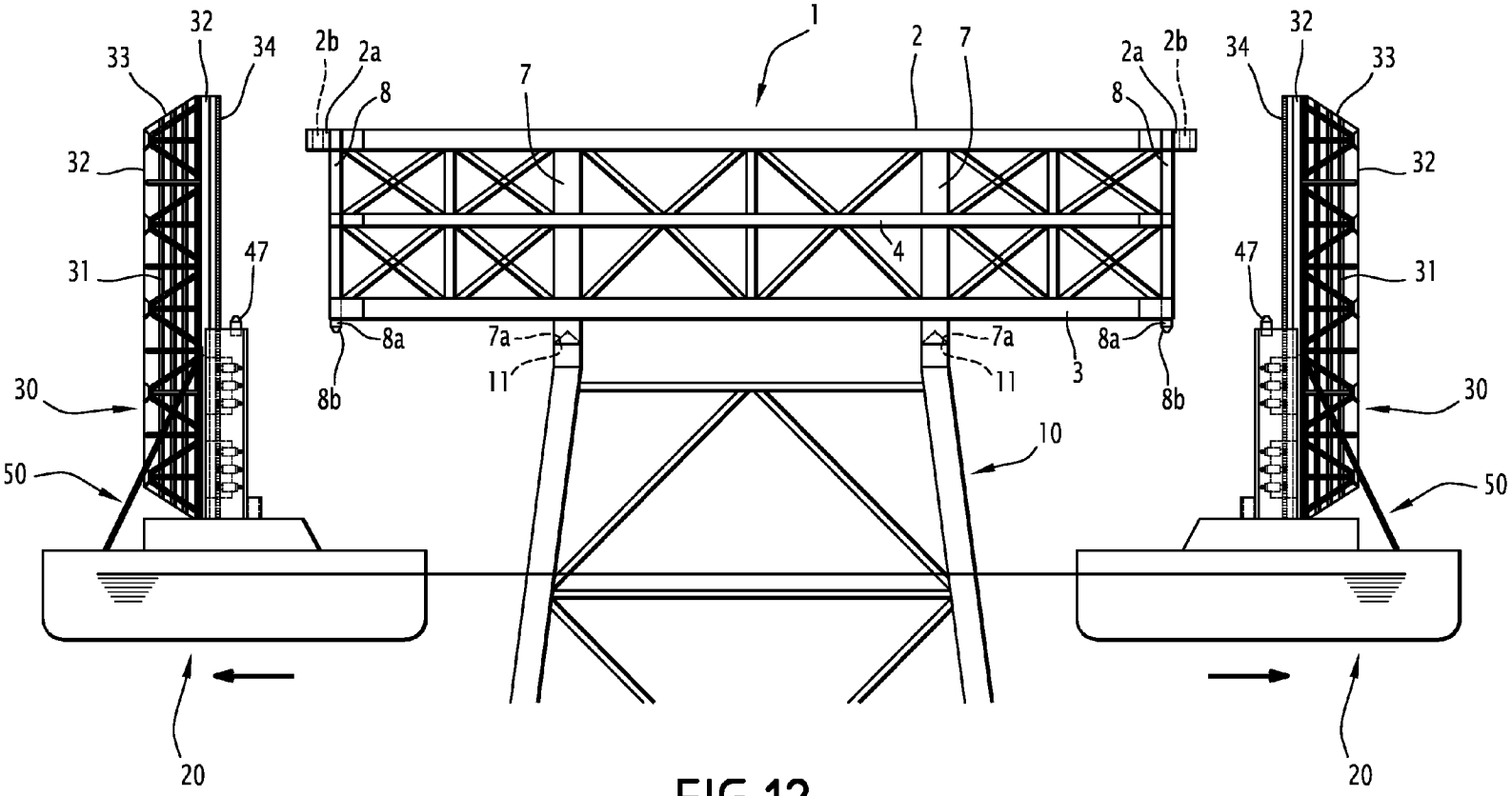

Deck 1 is attached on at least said supporting column 10 by means of suitable elements, not shown, and this deck 1 is detached from the shuttles 35 (FIG. 11). The shuttles 35 are brought back into a low position and the barges 20 are withdrawn laterally (FIG. 12).

The installation of the deck 1 on at least said supporting column 10 is carried out in the open sea and the sea conditions are never perfect and a residual swell is permanently present.

When the shuttles 35 are entirely disconnected from the deck 1, the barges 20 may begin to roll under the effect of the swell driving the columns 31 into a reciprocal movement. This motion may cause a major impact of the columns 31 on the deck 1.

In order to avoid this, each barge 20 is ballasted on its side opposite to the deck 1 by ballasting means 70 and the anchoring lines 72 connecting each barge to the sea bottom are pre-tensioned towards the outside of the barge. Thus, when the shuttles 35 are completely released from the deck, each barge 20 and the columns 31 will tilt in order to move away from the deck 1 and the anchoring lines will simultaneously move the barges away from this deck.

The barges 20 may also be used for dismantling and transporting the deck 1 of at least said supporting column 10 towards the transfer barge 15.

The transport barges 20 equipped with columns 31 beforehand, each provided with a shuttle 35 are placed on either side of at least said supporting column 10.

The shuttles 35 are displaced upwards on the columns 31 in order to secure these shuttles 35 with the deck 1 with temporary connection means formed by the lugs 47 and 8*b* cooperating with the housings, 2*b* and 45 respectively.

The deck 1 is detached from at least said supporting columns 10 and this deck is lifted by a shuttle 35 in order to move it away from at least said supporting column 10 and the transport barges 20 are displaced.

The shuttles 35 bearing the deck 1 are lowered and the deck 1 is attached onto the transport barges 20.

These transport barges 20 are moved in order to bring the deck up to the transfer barge 15 and the deck 1 is detached from the transport barges 20 and then lifted by the shuttles 35.

The transfer barge 15 is placed between the transport barges 20 below the deck 1 and the shuttles 35 are lowered in order to lay the deck 1 on the transfer barge 15.

The deck 1 is attached onto the transfer barge 15 and is detached from the shuttles 35.

The transport barges 20 are withdrawn and the deck 1 is transported by the transfer barge 15 up to a dismantling site.

The invention claimed is:

1. A structure for transporting a deck of an off-shore platform, and for installing or dismantling the deck on or from at least one supporting column of the off-shore platform, the structure comprising two transport barges and an apparatus configured for supporting and lifting the deck, the apparatus being temporarily connected to the deck and the barges, the apparatus being configured to be borne by the barges for supporting the deck between the barges, wherein the apparatus comprises vertical columns, and each vertical column includes a temporary attachment device configured to be temporarily attached to the corresponding barge, the attachment device being configured to allow an angular displacement of the corresponding column on either side of a longitudinal axis of the corresponding barge when the column is temporarily attached to the corresponding barge, and the structure further comprises legs associated with each vertical column for holding the vertical column in a vertical position, the legs being placed on opposite sides of the corresponding column, the legs being secured to the corresponding barge, the legs being configured to provide the corresponding column play for the angular displacement of the corresponding column and to limit the angular displacement of the corresponding column.

2. The structure according to claim 1, wherein the attachment device defines a temporary supporting area for each column on the corresponding barge.

3. The structure according to claim 1, further comprising a respective shuttle at each column, and a respective mechanical drive at each column, each drive being configured for displacing the respective shuttle at each column to be raised or lowered and the shuttle including temporary connection devices for connecting with the deck.

4. The structure according to claim 3, wherein the temporary attachment device of each column includes a half axle at a base of the column and extending parallel to the longitudinal axis of the corresponding barge and a housing on the barge with a shape mating that of the half-axle and the half axle and the housing are configured for being selectively connected and disconnected.

5. The structure according to claim 3, wherein the mechanical drive of each shuttle comprises at least two opposite assemblies borne by the corresponding shuttle, each assembly comprising a pinion configured and operable to be driven into rotation, the pinion being configured and operable to cooperate with a double rack borne by the corresponding column.

6. The structure according to claim 3, wherein the temporary connection devices of the shuttles with the deck comprise complementary fitting members borne by the shuttles and the deck and a lock configured for locking the deck on the shuttles.

7. A method for transporting a deck of an off-shore platform and for installing the deck onto at least one supporting column, the method comprising the following steps:

a) transferring the deck from an assembly quay onto a transfer barge, b) displacing the transfer barge bearing the deck so that the transfer barge is placed between two transport barges of a transport structure, c) providing columns on the transport barges and a shuttle on each column, and displacing the shuttles upwards on the columns so as to position the shuttles for securing the deck with the shuttles by temporary connection devices, d) lifting the deck by the shuttles in order to move the deck away from the transfer barge, e) wedging each of the columns on respective legs associated with a respective column for obtaining a rigid transport structure during transport of the deck, and withdrawing the transfer barge, respective legs associated with a respective column maintaining the respective column in a vertical position, the respective legs being placed on opposite sides of the respective column, the respective legs being secured to the corresponding transport barge, the respective legs being configured to provide the respective column play for an angular displacement of the respective column on either side of a longitudinal axis of the corresponding transport barge and to limit the angular displacement of the respective column, f) lowering the shuttles bearing the deck and attaching the deck on the transport barges, g) displacing the transport barges to bring the deck to a selected site which includes the at least one supporting column, h) detaching the deck from the transport barges, i) lifting the deck using the shuttles, j) displacing the transport barges in order to place the deck above the at least one supporting column, k) lowering the shuttles, l) laying the deck on the at least one supporting column, m) detaching the deck from the shuttles, n) lowering the shuttles, and o) withdrawing the transport barges, each column on the transport barges including a temporary attachment device configured to be temporarily attached to the corresponding transport barge.

8. The method according to claim 7, further comprising, prior to step m), connecting each transport barge to the sea bottom through pretensioned anchoring lines and ballasting each transport barge on a side of each transport barge opposite to the deck.

9. The method according to claim 7, further comprising prior to step b), attaching the columns bearing the shuttles onto the deck by the temporary connection devices then performing step b), lowering the columns bearing the shuttles to bring the columns bearing the shuttles into contact with the transport barges, mounting each of the columns bearing the shuttles on the transport barges with the temporary attachment device, and performing steps d) to o).

10. A method for detaching a deck of an off shore platform from at least one supporting column and transporting the deck for dismantling, the method comprising the following steps:

a) equipping transport barges with lifting columns, each lifting column bearing a shuttle, and placing the transport barges on either side of the at least one supporting column, b) displacing the shuttles upwards on the lifting columns to secure the deck with the shuttles and temporarily connecting the shuttles with the deck, c) detaching the deck from the at least one supporting column, d) lifting the deck by the shuttles to move the deck away from the at least one supporting column, e) displacing the transport barges bearing the deck, f) lowering the shuttles bearing the deck and attaching the deck onto the transport barges, g) displacing the transport barges to bring the deck to a transfer barge, h) detaching the deck from the transport barges, i) lifting the deck by the shuttles, j) placing the transfer barge between the transport barges and below the deck, k) lowering the shuttles to lay the deck on the transfer barge, l) attaching the deck onto the transfer barge, m) detaching the deck from the shuttles, n) lowering the shuttles, o) withdrawing the transport barges, and p) transporting the deck by the transfer barge to a dismantling site, each lifting column on the transport barges including a temporary attachment device configured to be temporarily attached to the corresponding transport barge, each lifting column being associated with legs for holding the lifting column in a vertical position, the legs being placed on opposite sides of the corresponding lifting column, the legs being secured to the corresponding transport barge, the legs being configured to provide the corresponding lifting column play for an angular displacement of the corresponding lifting column on either side of a longitudinal axis of the corresponding transport barge and to limit the angular displacement of the corresponding lifting column.

* * * * *